United States Patent [19]

Bolt

[11] 4,307,963

[45] Dec. 29, 1981

[54] CIGARETTE END TESTING

[75] Inventor: Reginald C. Bolt, London, England

[73] Assignee: Molins Limited, London, England

[21] Appl. No.: 744,765

[22] Filed: Nov. 24, 1976

[30] Foreign Application Priority Data

Dec. 1, 1975 [GB] United Kingdom ..... 49267/75
Nov. 3, 1976 [GB] United Kingdom ..... 45665/76

[51] Int. Cl.[3] ..... G01N 15/08

[52] U.S. Cl. ..... 356/445; 209/588; 250/273 R

[58] Field of Search ..... 250/223 R; 209/111.7, 209/577, 588; 356/209, 445

[56] References Cited

U.S. PATENT DOCUMENTS 3,729,636 4/1973 Merker ..... 250/223 R
3,812,349 5/1974 Gugliotta et al. ..... 250/223 R
3,818,223 6/1974 Gibson et al. ..... 356/102
3,980,567 9/1976 Benini ..... 250/223 R
4,001,579 1/1977 Lebet et al. ..... 250/223 R
4,011,950 3/1977 McLoughlin et al. ..... 209/111.7 R

*Primary Examiner*—R. A. Rosenberger
*Attorney, Agent, or Firm*—Craig and Antonelli

[57] ABSTRACT

A testing device for testing the ends of cigarettes, particularly to detect any tobacco ends which are inadequately filled with tobacco, comprises a light source arranged to direct a beam of light onto the ends of successive cigarettes, and a light detector which responds to a light signal which results from the beam of light and is dependent upon the quantity of tobacco in the ends of successive cigarettes (in the case of tobacco ends) or on the presence of a filter in the case of a test on the filter ends of filter-tipped cigarettes.

12 Claims, 6 Drawing Figures

CIGARETTE END TESTING

This invention is concerned with testing the ends of cigarettes in order to detect soft ends. In the case of a filter-tipped cigarette it is in fact useful to be able to test both ends: the tobacco end is tested in order to detect cigarettes having ends which are inadequately filled with tobacco, while a test on the filter end is useful to detect cigarettes with missing filters. Cigarettes with soft tobacco ends or missing filters should preferably be automatically ejected.

Earlier proposals in connection with cigarette end testing are described in our British patent specification No. 1,335,662.

According to the present invention, a testing device for testing the ends of cigarettes, particularly to detect any tobacco ends which are inadequately filled with tobacco, comprises a light source arranged to direct a beam of light onto the ends of successive cigarettes, and a light detector which responds to a light signal which results from the beam of light and is dependent upon the quantity of tobacco in the ends of successive cigarettes (in the case of tobacco ends) or on the presence of a filter in the case of a test on the filter ends of filter-tipped cigarettes.

A testing device according to this invention may take various forms, but there are two main forms which are as follows.

In the first main form of testing device according to this invention there is a nozzle arranged to direct a jet of air onto the wrapper of each cigarette to be tested, near the end which is being tested, the beam of light being directed onto the side of the cigarette at or near the position where the air jet hits the cigarette, so that the beam of light is reflected from the surface of the cigarette at an angle which depends upon the amount of inward deformation of the wrapper by the air jet. The light detector is preferably mounted in a position such that it receives a significant proportion of the light reflected from the wrapper of each cigarette with an adequately firm end, and receives less light or no light from the wrapper of a less firm cigarette. There is preferably a first optical system by which the light beam from the source is focused on a small area of the surface of the cigarette, the light detector being associated with an optical system focused on the same area.

In the second main form of testing device according to this invention, for testing the tobacco ends of cigarettes the beam of light is arranged to illuminate the tobacco near the end face of the cigarette to an extent which depends upon the quantity of tobacco in the end of the cigarette, and the light detector is arranged to detect the degree of illumination of that tobacco.

In this second form of testing device the light source is preferably arranged to direct a beam of light onto the side of each cigarette near the end, while the light detector is substantially axially in alignment with the end of the cigarette. Alternatively, however, the beam of light may be directed substantially axially onto the ends of successive cigarettes, in which case the light detector may be mounted at the side of the cigarette during testing so as to respond to the degree of illumination of the tobacco near the end face of the cigarette; in this last case the illumination of the tobacco would be detected through the cigarette wrapper.

Examples of testing devices according to this invention are shown in the accompanying drawings. In these drawings.

Figure 1:
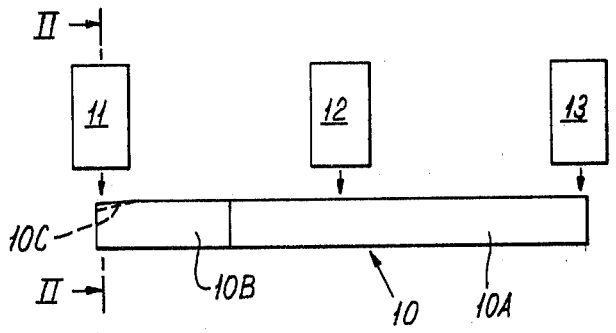
FIG. 1 is a side view showing a filter-tipped cigarette in the testing position of a testing device embodying the first main form of this invention.

FIG. 1 shows a filter-tipped cigarette 10 comprising a tobacco portion 10A and a filter 10B. The filter is joined to the tobacco portion by a piece of "tipping" paper which is wrapped around the filter and overlaps the adjacent end of the tobacco portion. During the assembly of filters with tobacco portions, in the event of the filter itself being missing, the tipping paper forms a hollow tube extending from one end of the tobacco portion; such cigarettes are unacceptable and are required to be ejected.

FIG. 1 shows two testing devices 11 and 13 adjacent to opposite ends of the cigarette 10. The device 11 detects missing filters, and the device 13 detects cigarettes with soft tobacco ends. Between the devices 11 and 13 there is a device 12 which is used to detect the presence of a cigarette, and stops the system from registering a fault when there is no cigarette present, for example while the cigarette making machine is being started.

Figure 2:
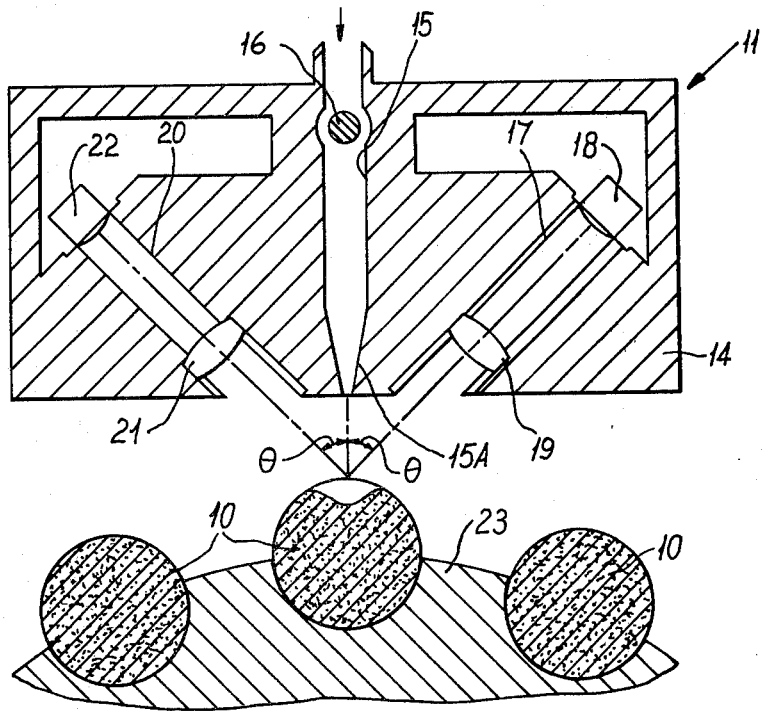
FIG. 2 is an enlarged fragmentary section on the line II—II in FIG. 1.

FIG. 2 is a section through the testing device 11. The device 13 is similar, while the device 12 is similar except that it does not include an air nozzle.

As shown in FIG. 2, the device 11 comprises a body 14 formed with a passage 15 which has a convergent downstream end portion 15A serving as a nozzle through which a jet of air is directed radially towards the cigarette 10. An adjustable restrictor 16 (shown diagrammatically) in the passageway 15 enables the strength of the air jet to be adjusted to suit different circumstances; for example, different cigarettes may ideally require air jets of different strength, and the missing filter detector 13 might require an air jet of different strength from the tobacco end tester.

On one side of the passage 15 there is a passage 17 at one end of which a light source in the form of a light-emitting diode 18 is mounted. The diode 18 may, for example, be that identified as the Motorola MLED 610, which has a diameter of 1.5 mm and is 2 mm long. The beam of light passing through the passage 17 is focused on the cigarette by means of an optical system comprising a lens 19 so as to produce a light spot on the cigarette approximately 1 mm$\times$1.5 mm in size. The axis of the beam and lens is inclined to the air jet by an angle $\theta$ which may be 45° as shown.

On the other side of the air passage 15 there is a passage 20 which is inclined to the passage 15 by the same angle $\theta$. At the lower end of the passage 20 there is an optical system comprising a lens 21 which is associated with a light detector in the form of a photo-transistor 22 having the same dimensions as the diode 18. The transistor 22 may be that identified as the Motorola MRD 603.

The lens 21 is focused on the spot on the surface of the cigarette (when undistorted) which is illuminated by the beam of light from the diode 18.

The axes of the passages 15, 17 and 20 (and accordingly also the axes of the lenses 19 and 21) all lie in a common plane normal to the axis of the cigarette 10 at the test station.

FIG. 2 also shows that successive cigarettes 10 are carried sideways past the testing devices on a fluted drum 23. The diode 18 is supplied with high-current pulses which are timed to coincide with the arrival of each cigarette in turn at the testing station, i.e. directly below the air nozzle. In other words, the diode 18 emits a beam of light only for a brief interval of time while each cigarette is directly aligned with the air jet. The same applied to the light-emitting diodes of the devices 12 and 13.

The air supplied to the nozzle 15A may, for example, be at about 2 pounds per square inch. The air jet is preferably adjusted by means of the restrictor 16 so as to be not strong enough to deform significantly the wrapper of a sufficiently firm cigarette, but to deform inwards a soft tobacco end (or a tipping paper tube without a filter) to an extent sufficient to reduce significantly the amount of light which then reaches the transistor 22. FIG. 2 shows, by way of example, how the wrapper or tipping paper of an unsatisfactory cigarette may be inwardly deformed by the air jet.

Light reflected off the surface of a sound cigarette tends to scatter, but we have found that sufficient light does reach the photo transistor 22 in the case of a satisfactory cigarette. When the surface of the cigarette is inwardly deformed to a significant extent, substantially no reflected light reaches the photo transistor, the light being mostly deflected right out of the plane containing the axes of the two optical systems on account of the inward inclination of the surface of the cigarette from which the light is reflected; as shown by the dotted line 10C in FIG. 1.

In this system a fault is signalled by the absence of a photo-electric output. A strobing system may be used, on the basis of a machine-derived strobe pulse, to power the diodes 18 at suitable intervals. In view of the rather low efficiency of optical reflection from a cigarette, it is important to pulse the diodes with a high current, for a short duration, when each cigarette in turn is at the test station.

Figure 3:
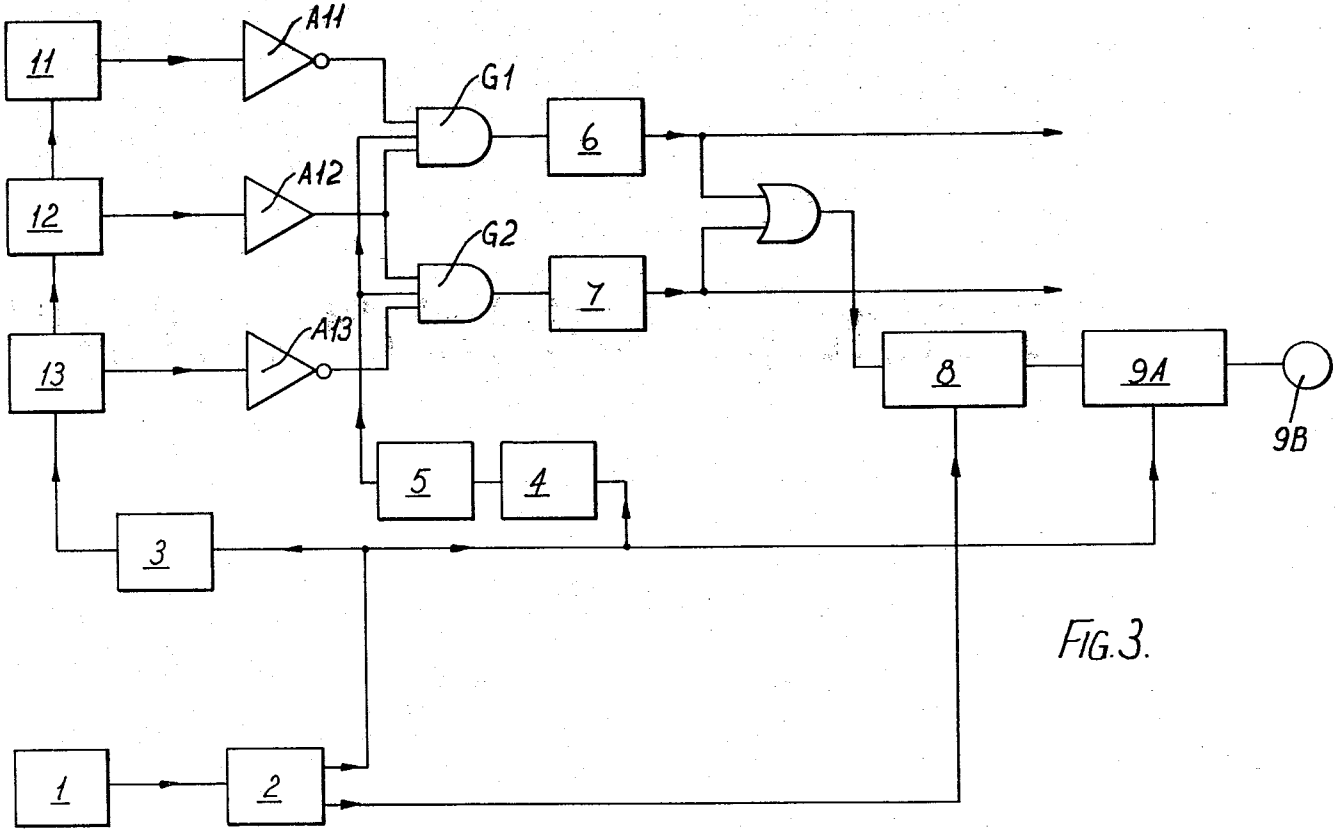
FIG. 3 is an electronic circuit diagram for the testing device shown in FIGS. 1 and 2.

A circuit diagram of the system is shown in FIG. 3. A machine-derived timing pulse from a device 1 triggers a monostable device 2, generating a pulse of 200 micro-second duration for every cigarette. From this, a current generator 3 delivers a pulse of 1 amp to each diode when the cigarette is in the position shown in FIG. 1.

The output of each of the detector devices 11, 12 and 13 is fed by an amplifier A11, A12 and A13. Amplifiers A11 and A13 are inverting amplifiers, while amplifier A12 is a non-inverting amplifier. Gates G1 and G2 receive strobe pulses (i.e. timed input pulses) from the monostable device 2 via a 150 micro-second delay device 4 and a 10 micro-second monostable device 5. Gate G1 produces an output for the duration of the strobe pulse if there is an output from the device 12 but not from device 11, that is to say in the case of a missing filter. Similarly gate G2 gives an output pulse for a cigarette with a soft end. From these gate outputs, fault pulses of five milli-second duration are produced by 5 milli-second monostable devices 6 and 7 respectively. These fault pulses may be transmitted to a data logging system.

Either catagory of fault (i.e. a missing filter or a soft tobacco end) provides the data input of a shift register memory 8 which is clocked by the trailing edge of the output of the monostable device 2. By means of this memory, faulty cigarettes may be removed, downstream of the test station, by a blast of air (in a known manner) released by a solenoid controlled valve 9B powered at the appropriate moment by a driver 9A which receives enabling pulses from the monostable device 2 as shown. The rejection device and the testing devices are so positioned with respect to the cigarette path that the same timing pulse can be used by each.

Tests on one example of equipment according to this invention using a 2 pounds per square inch source of compressed air produced the following results. The air jet deflected a typical soft cigarette end by approximately 1 mm to 1.5 mm at the end of the cigarette wrapper. The same strength of air jet produced a larger deflection at the filter end in the case of a missing filter.

The body 14 of each of the testing devices 11 and 13 may be formed with bleed passages extending from the air passage 15 to near the lenses 19 and 21 to blow air over the outer surfaces of the lenses to keep the lenses clean.

Figure 4:
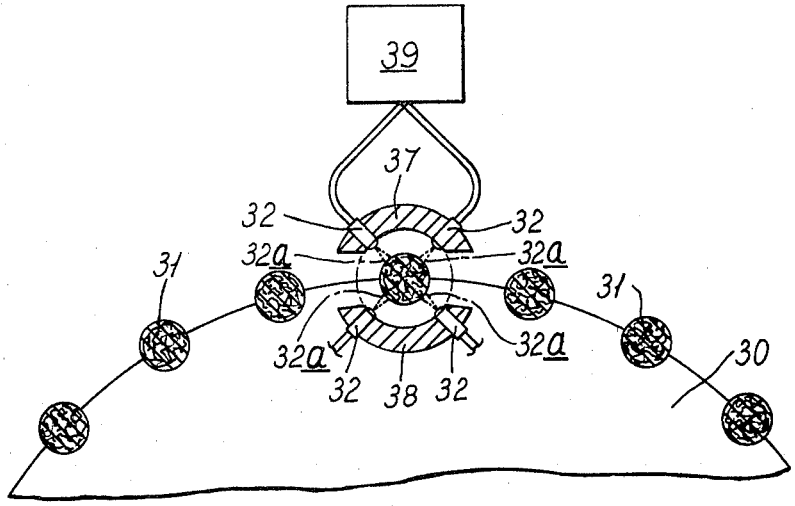
FIG. 4 is a fragmentary sectional view, on the line IV—IV in FIG. 2, of a testing device embodying the second main form of this invention.
Figure 5:
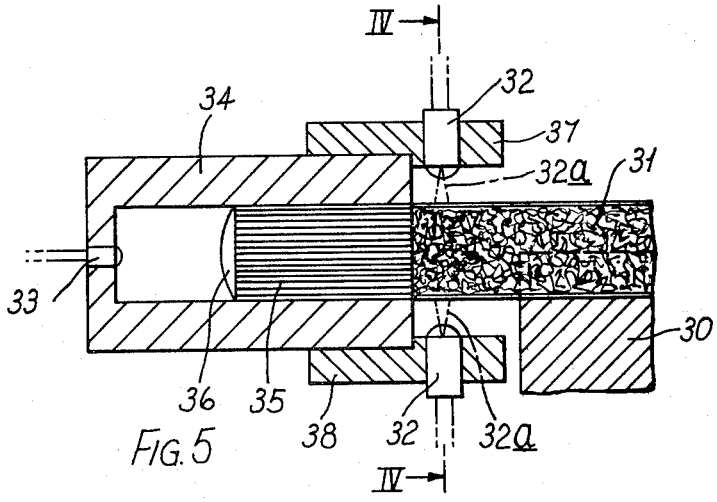
FIG. 5 is a sectioned fragmentary side view of the testing device of FIG. 4, showing the testing of one end of a cigarette.
Figure 6:
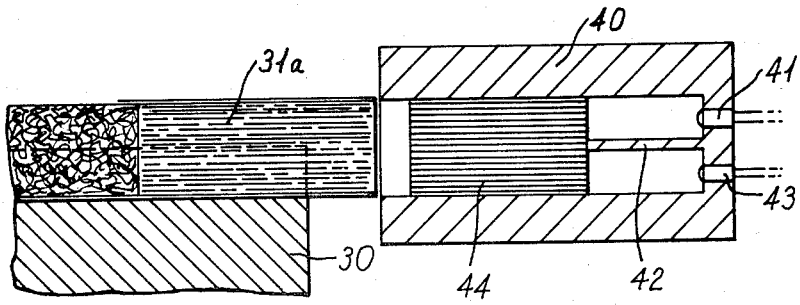
FIG. 6 is a view similar to FIG. 5, but showing the testing of the other end of the cigarette.

FIGS. 4 to 6

As shown particularly in FIG. 4, the testing device includes a fluted drum 30 which is arranged to carry successive cigarettes 31 sideways through a test station. At the test station, the tobacco ends of the cigarettes pass between two pairs of light sources 32 (FIGS. 4 and 5) which direct four beams of light **32*a* substantially radially towards the end portion of the cigarette being tested. Each beam of light 32*a*** may, for example, diverge by an angle of about 20° from a point source.

Also at the testing station there is a photo-cell or other light detector 33 carried at one end of a housing 34 which is mounted in a position such that the end face of the cigarette rubs lightly against the end face of the housing 34. A bundle 35 of light-transmitting fibres is secured within the housing and has an end face which is flush with the right-hand end of the housing so as to lie against the end of each cigarette during testing. A lens 36 in the housing causes the parallel beam of light which is transmitted by the bundle 35 to converge on to the light detector 33.

It will be noted that the light sources 32 are carried by arcuate members 37 and 38 respectively, which are in turn carried by the housing 34. The arrangement is such that the cigarettes pass between the inner and outer pairs of light sources with as little clearance as is practical, so that the light sources 32 can be as close as possible to the circumference of each cigarette during testing.

When each cigarette reaches the test station, a light beam of short duration is emitted by each of the light sources 32, and at the same time the test signal is obtained from the light detector 33. This test signal will be of a magnitude dependent upon the quantity of tobacco in the end portion of the corresponding cigarette. If the end portion of the cigarette is inadequately filled then the degree of illumination which is detected by the detector 33 will be greater than in the case of a properly formed cigarette. Cigarettes which are found in this way to have an inadequately filled tobacco end portion may be ejected downstream of the test station in any conventional way, for example by being blown axially or radially off the drum 30. A memory system may be used as described with reference to FIG. 3.

Each of the light sources 32 receives its power from a power unit 39. The light sources may, for example, be infrared light-emitting diodes. Such diodes can be powered with a high current for a very short duration, for example about 10 microseconds, thus providing a high-intensity light beam for a duration which is so short that the movement of the cigarettes relative to the light beams is insignificant. The cigarettes may, for example, move past the light detector at the rate of 4,000 to 5,000 per minute.

FIG. 5 shows the testing of the tobacco end portions of the cigarettes. It may also be desirable to test the filter ends to detect any cigarettes with missing filters. A cigarette with a missing filter may have a hollow tube of tipping paper which is intended to secure a filter portion to the end of the tobacco portion, though it occasionally happens that the filter portion is missing.

As shown in FIG. 6, a tubular housing 40 is mounted in a position such that it is coaxial with the cigarette under test and has its open left-hand end close to the end of the cigarette. For detecting missing filters a simpler arrangement may be used than in FIG. 5. This arrangement includes a single light source 41 which directs a beam of light axially towards the end of the filter portion 31*a* of the cigarette from one side of a dividing wall 42 in the housing 40. Light reflected back by the cigarette is detected by a light detector 43. The intensity of light reflected back to the detector 43 depends upon whether or not there is a filter portion; filter portions normally have a white end surface which reflects light relatively well, whereas in the absence of a filter portion the light beam from the source 41 impinges only on the end of the tobacco filling in the cigarette, so that less light is reflected back to the detector 43.

As shown in FIG. 6, the housing 40 also includes a bundle of light-transmitting fibres 44. This bundle may, however, be omitted, in which case the dividing wall 42 would be extended further towards the cigarette end.

The light source 41 is pulsed simultaneously with the light sources 32 by the power unit 39, for example as described with reference to the testing device shown in FIGS. 1 to 3.

It is important to note that the radial beams of light emitted by the light sources 32 lie in a plane which is inwardly spaced slightly, but not too far, from the end face of the cigarette. For example, the plane of the light beams may lie 2 to 3 mm from the end face of the cigarette. If the cigarette is adequately filled with tobacco, then, as a result of scatter and absorbsion of the light by the tobacco, relatively little light reaches the light detector 33. However, if the end of the cigarette is inadequately filled with tobacco, then more light will reach the light detector, which will produce an output signal indicating that the cigarette is faulty and is to be ejected.

It is possible, in principle, to use a single light source 32 instead of four as shown. However, it is better to use a number of light sources to producing beams of light from various directions (preferably evenly spaced around the cigarette) to help to ensure that a cigarette end which has a significant quantity of tobacco missing on one side can be detected.

It is important to note that the bore in the housing 34 through which light is transmitted to the detector 33 is substantially the same diameter as the cigarette, so that light from substantially the whole end face of the cigarette is received by the detector. In order to prevent any light from any of the light sources 32 passing directly to the detector (e.g. by reflection off the cigarette wrapper) the bore in the housing 34 should not be larger than the cigarette diameter.

The lens 36 may be omitted if a larger-diameter light detector 33 is used.

In place of the bundle of fibres 35, there may be a rod of glass or other translucent material which is preferably machined flush with the end of the housing 34 contacting the cigarettes.

I claim:

1. A testing device for testing the ends of cigarettes, particularly to detect any tobacco ends which are inadequately filled with tobacco, comprising a nozzle for directing a jet of air onto the cigarette wrapper near the end of the cigarette which is being tested, a light source arranged to direct a beam of light onto the wrapper at or near the position where the air jet hits the cigarette, so that the beam of light is reflected from the surface of the cigarette at an angle which depends upon the amount of inward deformation of the wrapper by the air jet, and a light detector responsive to light reflected from the cigarette for detecting the quantity of tobacco in the end of the cigarette (in the case of a tobacco end) or the presence of a filter in the case of a test on the filter end of a filter-tipped cigarette.

2. A testing device according to claim 1, in which the light detector is mounted in a position such that it receives a significant proportion of the light reflected from the wrapper of each cigarette with an adequately firm end, and receives less light or no light from the wrapper of a less firm cigarette.

3. A testing device according to claim 2 including a first optical system by which the light beam from the source is focused on a small area of the surface of the cigarette, and in which the light detector is associated with an optical system focused on the same area.

4. A testing device according to claim 3 in which the axes of both optical systems lie in a plane normal to the axis of the cigarette under test.

5. A testing device according to claim 4 in which the air jet is directed radially onto the cigarette along a path which bisects the angle between the axes of the two optical systems.

6. A testing device according to claim 1 in which the light source is a light-emitting diode which is powered by short pulses of current timed to coincide with the arrival of successive cigarettes at the testing station.

7. A testing device for testing the tobacco ends of cigarettes to detect cigarettes of which the tobacco ends are inadequately filled with tobacco, comprising means for conveying a succession of cigarettes sideways to a test station, a plurality of light sources at the test station for directing beams of light substantially radially towards each cigarette in turn at the test station along paths spaced around the cigarette and lying substantially in a plane which is normal to the axis of the cigarette and is inwardly spaced from the end of the cigarette, so that the light passes through the cigarette wrapper before it reaches the tobacco filler, the entire area of the cigarette which each beam strikes being inwardly spaced from the adjacent end of the cigarette, and including a light detector and means for directing only the light from the end face of the cigarette at the testing station to said light detector to detect cigarettes with inadequately filled tobacco ends.

8. A testing device according to claim 7 in which the light is transmitted to the light detector from the end of each cigarette in turn by a bundle of light-transmitting fibres.

9. A testing device according to claim 8 in which the bundle of light-transmitting fibres has a diameter substantially equal to that of the cigarettes.

10. A testing device according to claim 7 in which said light sources are connected to means for generating short-duration pulses of current timed to coincide with the arrival of successive cigarettes at the test station.

11. A testing device according to claim 7 in which said light directing means is arranged so that the light detector will receive light from substantially the entire area of the end face of the cigarette at the testing station.

12. A testing device according to claim 11 in which said light directing means comprises a tubular housing which is mounted adjacent to the test station so as to lie substantially co-axially with the cigarette at the test station, the housing having a light-transmitting bore of substantially the same diameter as the cigarette and having an end face which lies adjacent to the end face of each cigarette in turn at the test station.

* * * * *